United States Patent [19]

Kennedy

[11] Patent Number: 4,867,367

[45] Date of Patent: Sep. 19, 1989

[54] FASTENER WITH MAGAZINE

[75] Inventor: George W. Kennedy, Pompano Beach, Fla.

[73] Assignee: Kentec, Inc., Atlanta, Ga.

[21] Appl. No.: 153,768

[22] Filed: Feb. 8, 1988

Related U.S. Application Data

[63] Continuation-in-part of Ser. No. 882,345, Jul. 7, 1986, Pat. No. 4,728,021.

[51] Int. Cl.[4] ..... B25L 5/06; B25L 5/16

[52] U.S. Cl. ..... 227/120; 227/156

[58] Field of Search ..... 227/120, 116, 156

[56] References Cited

U.S. PATENT DOCUMENTS

| | | | |
|---|---|---|---|
| 4,199,095 | 4/1980 | Yamanoi | 227/120 X |
| 4,574,991 | 3/1986 | Thorsen, Jr. | 227/120 X |
| 4,762,262 | 8/1988 | Ming | 227/120 |

*Primary Examiner*—Bell Paul A.

*Attorney, Agent, or Firm*—Thomas & Kennedy

[57] ABSTRACT

A fastener machine and fastener supply magazine therefor include a fastener guide in the machine and means for impelling fasteners along the guide to a fastened driving head, while the magazine automatically feeds clips of fasteners to the guide means from a stack of fastener clips contained in the magazine.

23 Claims, 3 Drawing Sheets

FASTENER WITH MAGAZINE

CROSS REFERENCE TO RELATED APPLICATION

This application is a continuation-in-part of U.S. patent application, Ser. No.882,345, filed July 7, 1986, now U.S. Pat. No. 4,728,021.

BACKGROUND OF THE INVENTION

This invention relates in general to automatic fastening machines used in continuous production lines, and more particularly, to a fastener supply magazine for permitting rapid replenishment of fasteners without interrupting production.

Automatic fastening machines such as used to drive staples or the like into wooden lattices, pallets, or fence panels, for example, can be multiply mounted side-by-side on a support frame above a surface conveyor which carries the work product beneath the fastener machines, and are actuated by triggering devices responsive to the movement of the work product to a predetermined position to drive staples or other type fasteners into the work product. Such automatic systems generally run at higher speeds than any achievable in manual operation, and expend fasteners at an extremely high rate.

For example, in stapling together the intersections of a lattice, the fastening machines can use up to a thousand staples per minute. The normal supply magazine for an automatic fastening machine holds approximately one hundred and fifty staples and, in such high speed operation, must be reloaded as often as every three minutes. In prior art fastening machines, the staples are fed from the magazine onto a track and are urged toward the driven head by a spring biased pusher in contact with the rearmost staple in the clip or stick of staples. Thus when the staple supply must be replenished, it is necessary that the pusher be retracted to make room for a new stick or clip of staples to be placed on the track or guide means. In order for the pusher to be retracted, it is necessary to interrupt the fastening process and such interruptions which can occur at intervals of about three minutes result in a loss of productivity.

The co-pending U.S. patent application, Ser. No. 882,345, now U.S. Pat. No. 4,728,021 of which the present application is a continuation-in-part, discloses a fastener machine which utilizes a fastener advancing means which operates without the usual pusher and which is open above and behind the fastener clip guide means, thereby allowing new clips of staples or other type fasteners to move by gravity from the fastener magazine onto the guide means, thus obviating the interruption of operation to replenish the supply of staples or other type fasteners. More particularly, the fastener advancing means comprises a fastener guide means upon which clips of staples or other type fasteners from the fastener magazine travel in an upright altitude toward the drive element. The movement of the clips is caused by friction numbers engaging the side surfaces of the fastener clip or stick and which are moved forward toward the drive element on each cycle of operation of the drive element. The friction members then relax and retract until the next cycle, at which time they again engage the sides of the clip and urge it forward. Such action as just described insures that the leading fasteners of the clip is properly positioned beneath the drive element before the drive element is actuated.

SUMMARY OF THE INVENTION

The present invention comprises a fastener clip supply magazine for use in the type of fastener system described in application Ser. No. 882,345 which insures a large supply of fastener clips or sticks, which indicates when the supply of clips in the magazine is low, which prevents jamming of the clips as they leave the magazine and drop onto the guide, and, most importantly, which are quickly interchangeable with magazines that have been emptied during operation.

Briefly described, the magazine comprises a clip or stick holding chamber in which a plurality of clips of fasteners are stacked on top of each other in side to side orientation, with the sharpened ends of the fasteners extending laterally. In the case of U-shaped staples, for example, the clips are stacked with their open ends facing the rear of the chamber and with their side legs abutting. Such an arrangement permits an increased number of clips to be contained in the magazine, and facilitates the movement of a clip from the bottom of the magazine onto the fastener machine guide member. The magazine is adapted to be slipped over a pair of support members affixed to the machine and to be held in place by spring latches affixed to the support members after the magazine has been slipped down the support members into its operative position. At the lower end of the magazine is a spring loaded gate which is normally biased to a closed position so that the loaded magazine can be transported to the fastening machine without loss of any clips, but which is forced open when the magazine is dropped into its operative position on the machine. When the gate is open, clips are free to drop therethrough onto the machine guide member.

The bottom of the magazine is closed by a bottom plate which is mounted on a pair of rods extending lengthwise of the magazine relative to the machine, and which is equipped with a pair of flared ears on its underside which engage a sloping plate on the machine. The sloping plate reciprocates with the clip drive means on the machine, thereby causing the bottom plate of the magazine to reciprocate also. The bottom plate is spring loaded on at least one of the rods so that when the magazine is inserted, the flared ears on the bottom plate move the plate into proper position relative to the sloping plate, and the spring bias insures proper engagement therewith. Thus when the machine and its reciprocating pusher mechanisms are in operation, the bottom plate reciprocates with the pusher mechanism, thereby insuring that the bottom clip of the stack in the magazine does not stick to the next clip above nor jam as it drops through the gate.

It is, therefore, an object of the invention to provide a fastener clip magazine which automatically supplies clips of fasteners to the guide means of the fastener without jamming.

It is another object of the invention to provide a fastener clip magazine which is readily and quickly interchangeable with a clip magazine already on the fastener machine.

It is still another object of the invention to provide a fastener clip magazine and mounting therefor which does not exceed the space limits created by a plurality of fastening machines situated side-by-side.

Still another object of the invention is the provision of a self closing fastener clip magazine which may be transported without loss of fastener clips therefrom.

Other objects, features, and advantages of the present invention will be more readily apparent from the following detailed description, read in conjunction with the accompanying drawings.

DETAILED DESCRIPTION

Figure 1:
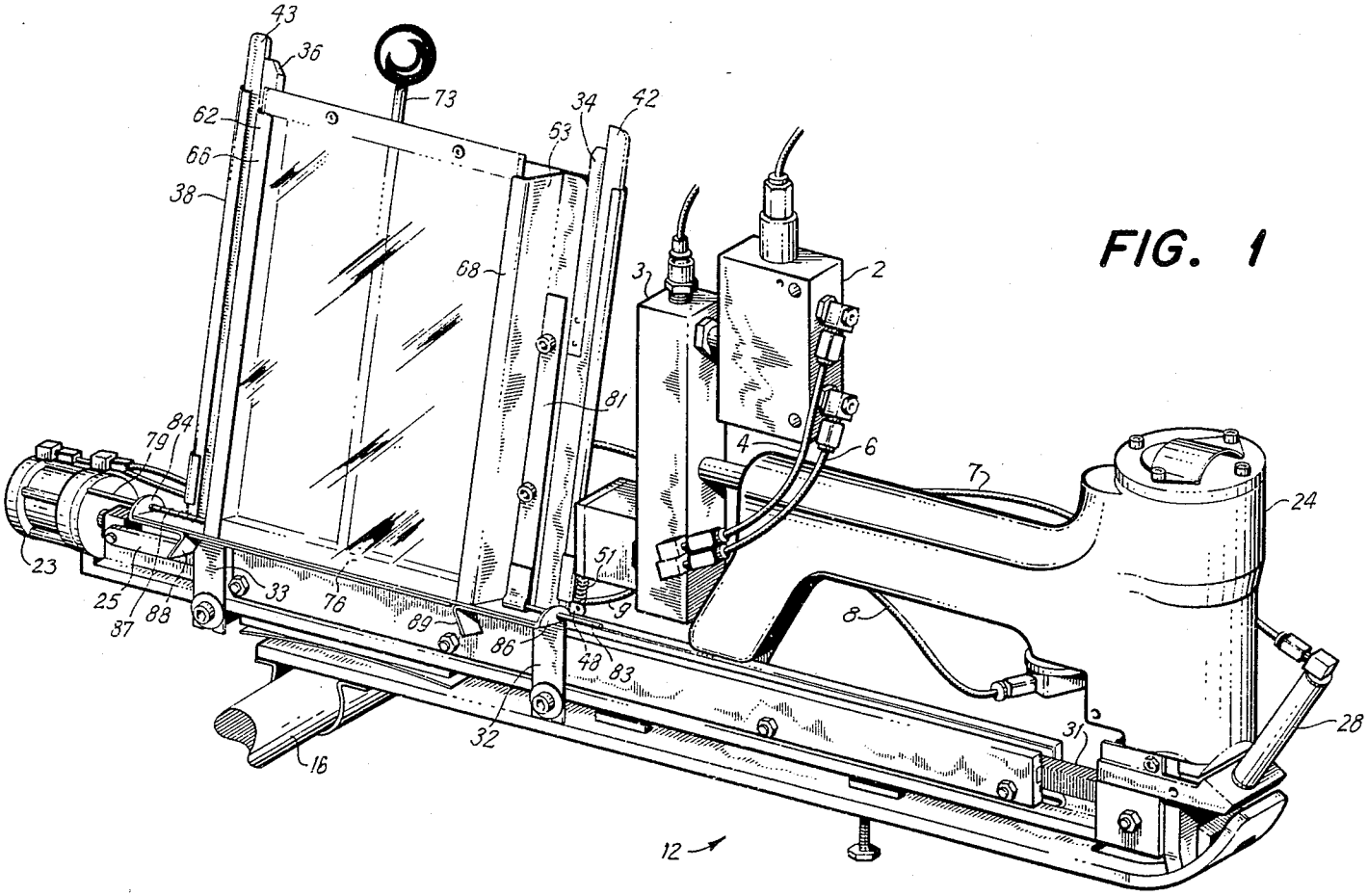
FIG. 1 is a perspective view of the fastening machine with its clip magazine.

FIG. 1 is a perspective view of a fastening machine 12 in which a staple containing magazine 38 supplies clips 31 of staples to a driving head 24, in a manner which will be discussed more fully hereinafter, and which is fully explained in U.S. Pat. No. 4,728,021.

The entire machine 12 including driving head 24 and cylinder and piston members 23 and 28 is pneumatically powered, and pneumatic control members 2 and 3 and associated air hoses 4, 6, 7, 8 and 9 supply air to the cylinders in the proper sequence.

Figure 2:
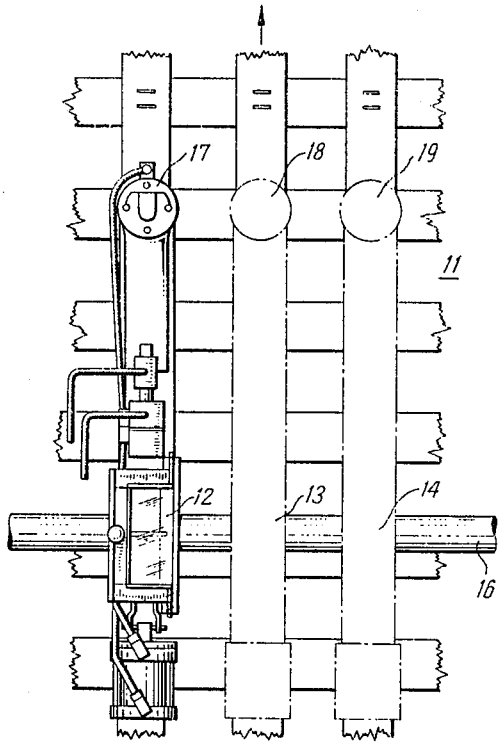
FIG. 2 is a plan view of a portion of a production line set-up having machines utilizing the present invention.

FIG. 2 depicts a production line arrangement for making a lattice sheet 11 utilizing a plurality of fastening machines, three of which , 12, 13, and 14, are shown. It is to be understood that, depending upon the width of the lattice 11, a large number of such machines mounted on a support member 16 in close proximity to each other, may be necessary. The driving heads 17, 18 and 19 of the machines rest upon the workpiece 11 as it is carried by a conveyor belt, for example, past the machines in the direction of the arrow. Triggering means, not shown, are activated by the workpiece position so that the driving heads 17, 18 and 19 are actuated as the lattice intersections pass thereunder. As discussed heretofore, the lattice 11 moves rapidly in a production line environment as shown in FIG. 2, and large numbers of fasteners, e.g. staples, are consumed in a short space of time, requiring, in the prior art, the frequent stopping of the conveyor while new staples are added.

Figure 3:
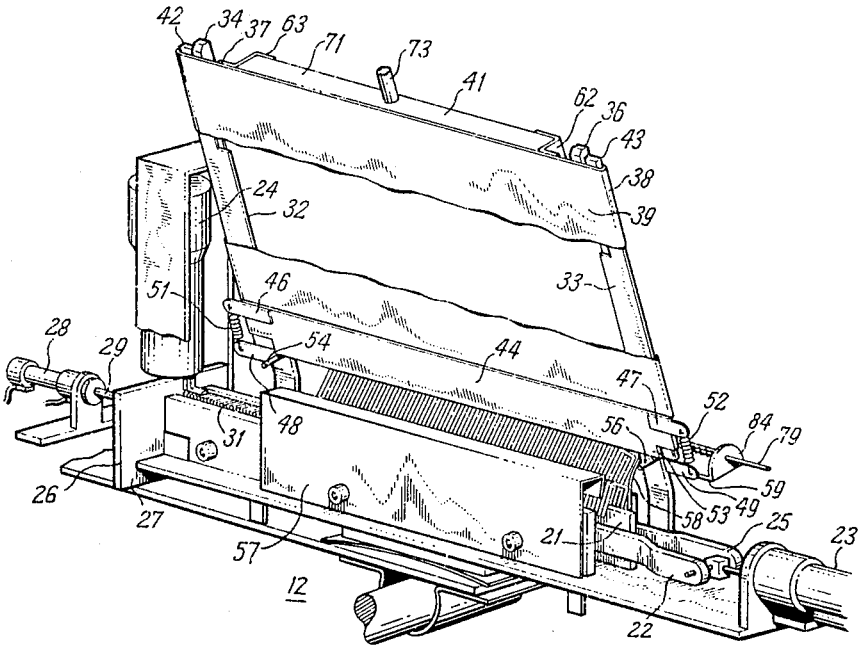
FIG. 3 is a perspective view similar to FIG. 1 but showing the other side of the machine.

In FIG. 3 there is shown a fastening machine 12 of the type disclosed and claimed in U.S. Pat. No. 4,728,021, which includes the clip magazine and mounting arrangement therefor of the present invention. Machine 12 includes a staple guide 21 with staple advancing means 22 and 25 powered by a pneumatic cylinder 23. The staple driving head 24 is shown directly over a staple discharge gap 26 formed between staple guide 21 and a discharge chute gate 27. A pneumatic cylinder 28 is shown with an extension shaft 29 in its distended position abutting the back side of discharge chute gate 27. A clip 31 of staples is shown mounted on guide 21. The operation of machine 12 is more fully explained in U.S. Pat. No. 4,728,021 and will not be repeated here, other than to point out that in operation, members 22 and 25 have imparted thereto a reciprocating action by cylinder 23.

Fixedly mounted on the frame of machine 12 are first and second guide members 32 and 33, which are inclined toward the center of machine 12 as shown. The upper ends of guide members 32 and 33 have mounted thereon a pair of spring clips 34 and 36, respectively, which are designed to engage the top edge 37 of the clip magazine 38 and hold the magazine firmly in place in its operative position. Magazine 38 comprises a back plate 39 and a clip holding chamber 41. The edges of back plate 39 are bent to form channels 42 and 43 which fit around support members 32 and 33 to prevent movement of the magazine 38 in the longitudinal direction. At the lower end of plate 39 is a slideable gate member 44, the ends of which are bent to form channels which fit around the bent edges of plate 39 to hold gate 44 slideably in place on plate 39. Mounted on each end of gate member 44 at the top thereof are first and second drilled tabs 46 and 47, and mounted at the bottom of plate 39 at each end thereof are corresponding drilled tabs 48 and 49. Connected between the holes drilled in tabs 46 and 48 is a coil spring 51, and a corresponding spring 52 is connected between drilled tabs 47 and 49. The tension of springs 51 and 52 is such that gate 44 is normally biased toward the bottom of back plate 39, thereby closing an opening, not shown, but which is disclosed in FIGS. 4 and 5, through which staples are supplied to guide 21. However, when magazine 38 is inserted onto members 32 and 33, and pressed down into its operative position, the bottom edge 53 of gate 44 engages a pair of pins 54 and 56 mounted in members 32 and 33, thereby forcing gate 44 open and providing a passage for staple clips or sticks to pass down to guide 21.

Mounted on machine 12 opposite the opening in magazine 38 is a staple clip positioning plate 57, and mounted on member 25 under the magazine 38 is a sloping plate 58. As will be explained more fully hereinafter, when gate 44 is open, staple clips slide down sloping plate 58 until the ends of the staples strike plate 57 which causes the open end of the staple clip to drop down onto guide 21. Magazine 38 is closed at the bottom by a spring loaded bottom plate 59 which engages sloping plate 58 and reciprocates therewith as will be explained more fully hereinafter.

Figure 4:
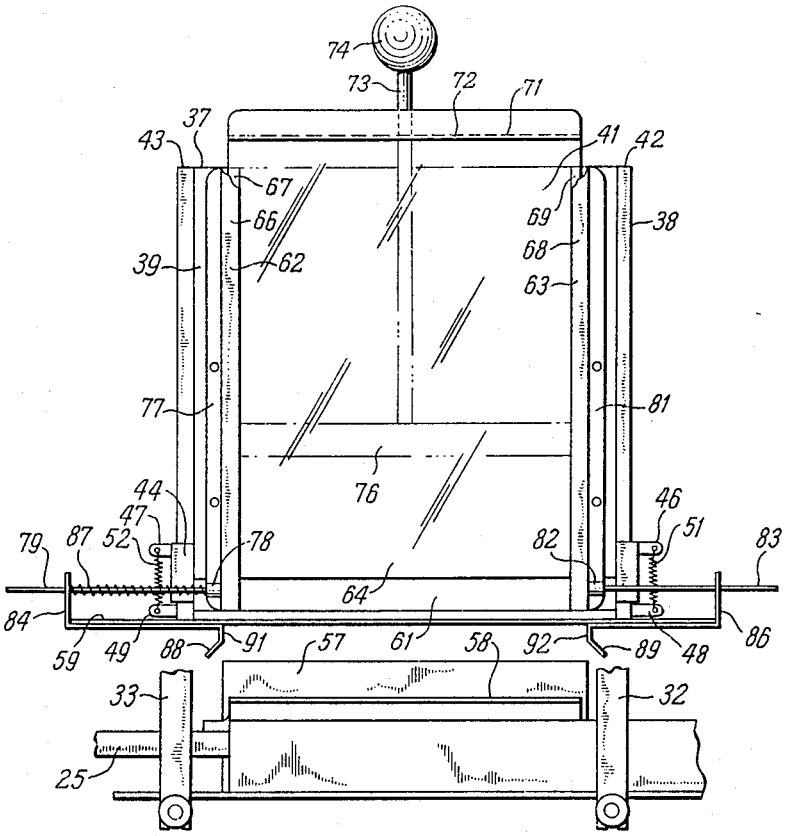
FIG. 4 is an elevation view of one side of a magazine embodying the present invention.

FIG. 4 depicts a front view of magazine 38 positioned slightly above its operative position, and shows the means by which bottom plate 59 engages sloping plate 58, as well as the details of bottom plate 59. As shown in FIG. 3, the opening 61 through which the staple clips pass is closed by gate 44 since the bottom edge 53 of gate 44 has not been engaged by pins 54 and 56. Clip holding chamber 41 is formed by first and second flange members 62 and 63 which are affixed to back plate 39 and extend therefrom a distance sufficient to accommodate a staple clip lying on its side. The chamber 41 is closed by a transparent member 64, shown partially raised from its fully closed position. Member 64 is held in place by channels formed in flange members by first and second lips 66, 67 and 68, 69, and is free to slide up and down therein. At the top of member 64 is a closure plate 71 with a hole 72 in the center thereof through which extends a rod 73. At the top end of the rod is mounted a spherically or other suitably shaped member 74 and at the bottom end of rod 73 is mounted a weighted member 76 which bears against the topmost clip of staples within chamber 41. In operation, as the clips of staples are removed from chamber 41, members 74 and 76 drop down. Thus, member 74 serves as an indicator of when the supply of staples is becoming or has been depleted and that it is necessary to replace the magazine with a filled magazine.

Mounted adjacent flange member 62 is a spring member 77, having at its lower end a mounting looped portion 78 in which is mounted a rod 79. In like manner a spring member 81 is mounted adjacent flange member 63 and has a looped portion 82 in which is mounted a rod 83. Bottom plate 59 is suspended from rods 79 and 83 by means of a pair of upturned ears 84 and 86 through which rods 79 and 83 pass. A coil spring 87 is mounted on rod 79 and function to center bottom plate 59 in the inoperative state, while permitting movement thereof during operation. Mounted on the underside of plate 59 are first and second flared ears 88 and 89 which, as magazine 38 is lowered into its operating position, contact the ends of sloping plate 58 to center plate 59 with respect thereto. Ears 88 and 89 have straight portions 91 and 92 which engage the ends of plate 58 so that, during operation, plate 59 moves with reciprocating plate 58. Inasmuch as the lowermost staple clip rests on the upper surface of plate 59, the reciprocal movement of plate 59 is imparted to the clip, which, while not free to move reciprocally, is nevertheless vibrated sufficiently to insure its being loose within chamber 41, with respect both to the staple clip lying on top of it and with respect to the surfaces of the chamber 41 with which it may be in contact.

Figure 5:
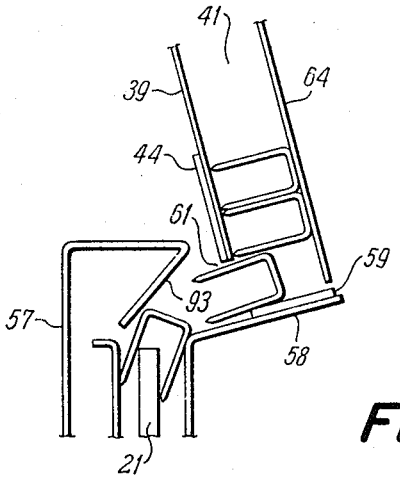
FIG. 5 is a sectional view illustrating how the clips move out of the magazine.

FIG. 5 is a sectional view in which the manner by which staple clips are transferred from the chamber 41 to the guide 21 is depicted. As can be seen in FIG. 5, gate 44 has been raised, and opening 61 is clear. Because of the reciprocal action of plates 58 and 59, a clip of staples slides through opening 61 until it strikes the sloping face 93 of member 57, which cams it downward, as shown, until the open end drops over guide 21. When the clip is in position on guide 21, it will slide under the next clip as it is driven forward and when the guide is again clear, the next clip drops into place.

The magazine of the invention is, in some respects, similar to a rifle clip in that it may be loaded and transported as a self contained unit, and quickly snapped into place when replacing an empty clip. The operator of the stapling arrangement depicted in FIG. 1, can monitor the status of all of the magazines by observing the position of the indicators 74, and change clips on any or all of the machines rapidly and without any interruption of the stapling or fastening, hence the production process.

While the present invention has been described in detail with particular reference to an embodiment using staples, it is obvious that the invention is readily adaptable to other types of fasteners, such as, for example, nails. Numerous changes or modifications of the present invention may be made by workers in the art without departure from the spirit and scope of the invention as set forth in the following claims.

I claim:

1. A fastener clip magazine for mounting on and dispensing elongated clips of fasteners to a fastening machine, with the clips of fasteners each comprising a plurality of fasteners connected together in abutting relationship with pointed ends extending in a common direction, said magazine comprising means for storing clips of fasteners in horizontally extending parallel attitude and upwardly stacked relationship with the pointed ends of the fasteners extending laterally in one direction, a bottom plate for supporting the lowermost fasteners in said magazine, a side opening formed in said magazine above said bottom plate, and means for vibrating said bottom plate to dispense the lowermost clip of fasteners laterally out of the opening.

2. A fastener clip magazine as claimed in claim 1, wherein said movable bottom plate engages and reciprocates with a reciprocating member on the fastening machine.

3. A fastener clip magazine as claimed in claim 1 wherein said magazine includes an opening adjacent said movable bottom plate through which said lowermost clip of fasteners passes to said machine.

4. A fastener clip magazine as claimed in claim 3 and further including gate means for closing said opening when said magazine is removed from the machine.

5. A fastening machine of the type used to drive fasteners from an end of a clip of fasteners into a work product, the clip of fasteners comprising fasteners connected to one another in an elongated clip of aligned, parallel fasteners, said fastening machine including a guide means having a fastener discharge end, a drive element at said discharge end of said guide means for driving the endmost fastener at one end of the clip from the clip of fasteners on said guide means, said machine including fastener drive means which impels the clip of fasteners on said guide means toward said drive element while leaving the top and rear of the clip on said guide means open, and means on the machine for mounting a magazine of fastener clips above a moveable sloping plate on said machine adjacent said guide means, a magazine for carrying and supplying fastener clips to said machine, said magazine comprising a back plate and a clip containing chamber, said back plate having an opening therein to permit passage of fastener clips from said chamber to the moveable sloping plate, gate means for closing said opening and means for raising said gate means to clear said opening when said magazine is mounted in operative position on the mounting means on said machine.

6. The machine as claimed in claim 5 and further including a moveable bottom plate on said magazine, and means on said bottom plate for engaging the moveable sloping plate on said machine.

7. The machine as claimed in claim 6 wherein said means for engaging the moveable sloping plate comprises first and second flared ears spaced apart a distance substantially equal to the length of the moveable sloping plate.

8. The machine as claimed in claim 5 wherein said means for mounting said magazine comprises first and second elongated spaced members affixed to said machine and extending there above.

9. The machine as claimed in claim 8 wherein said elongated spaced members have affixed thereto means for retaining said magazine in its operative position.

10. The machine as claimed in claim 8 wherein said elongated spaced members extend upward from said machine at an angle thereto.

11. The machine as claimed in claim 8 wherein said means for raising said gate comprises first and second pins affixed to said first and second elongated spaced members respectively adjacent said sloping plate.

12. In combination a fastening machine of the type used to drive fasteners from the end of a clip of fasteners into a work product and a magazine for storing and feeding clips of fasteners to said fastening machine, said clips of fasteners comprising fasteners connected to one another in an elongated clip of aligned parallel fasteners with pointed ends extending in a common direction, said fastening machine including a guide means having a fastener discharge end, a fastener drive element at the discharge end of said guide means for driving the endmost fastener at one end of a clip from the clip of fasteners on said guide means, and fastener advancing means for urging the endmost fastener of the clip of fasteners on said guide means to a position adjacent said drive element, said fastener advancing mean including at least one fastener advancing means positioned out of alignment with the length of the clip of fasteners on said guide means and means for intermittently urging said clip engaging element into contact with said clip of fasteners on said guide means and urging said clip along the length of said guide means toward said drive element, said magazine including means for storing clips of fasteners in an upwardly stacked arrangement with the pointed ends of the fasteners extending in a common lateral direction, a movable bottom plate supporting the lowermost clip of fasteners in said magazine, an opening formed in said magazine adjacent said bottom plate and in alignment with the guide means of said fastening machine and means for moving said bottom plate to dispense the lowermost clip of fasteners laterally out of the opening of said magazine and onto the guide means of said fastening machine.

13. A fastener clip magazine for use on a fastening machine having a clip guide therein, said magazine comprising a back plate adapted to be mounted on the machine, a clip containing chamber mounted to said back plate and having upper and lower ends and first and second sides, said back plate having an opening therein adjacent the lower end of said chamber for permitting fastener clips to pass therethrough to the clip guide of said fastening machine, gate means for covering said opening, said gate means being adapted to uncover said opening when said magazine is mounted on the fastening machine, and a movable bottom plate covering the bottom end of said chamber for supporting fastener clips within said chamber and means for moving said bottom plate to dispense the lowermost clip of fasteners through said opening to the clip guide of said fastening machine.

14. A fastener clip magazine as claimed in claim 13 wherein said chamber includes a front plate spaced from said back plate, said front plate being slideably mounted on a pair of members forming said first and second sides of said chamber, said front plate having a cover plate mounted thereon adjacent the upper end of said chamber when said front plate is mounted in operative position on said pair of members.

15. A fastener clip magazine as claimed in claim 14 and further including a rod member extending through said cover plate in slideable relation thereto, and into said chamber, the end of said rod within said chamber having a weighted member attached thereto and the other end of said rod having an indicator member attached thereto.

16. A fastener clip magazine as claimed in claim 13 wherein said cover means has an upper surface facing said chamber and a lower surface to which are affixed first and second flared ears.

17. A fastener clip magazine as claimed in claim 13 wherein said cover means is terminated at its ends by first and second flange members, and mounting means for said cover means comprising first and second rods extending through said first and second flange members respectively in slideable relation thereto, said first and second rods being affixed to said back plate.

18. A fastener clip magazine as claimed in claim 17, wherein a spring member is mounted on at least one of said rods and extends between said flange member and the point where said rod is affixed to said back plate.

19. In combination, a fastening machine for driving fasteners into a work product and including a fastener guide for guiding features to a fastener drive element, and a fastener clip magazine for mounting on and dispensing elongated clips of fasteners having pointed ends to said fastener guide of the fastening machine, said magazine comprising means for storing clips of fasteners in horizontally extending parallel attitude and upwardly stacked relationship with the pointed ends of the fasteners extending laterally in one direction, a movable bottom plate for supporting and urging the lowermost clip of fasteners laterally out from the stacked arrangement and out of said magazine, and means for turning said lowermost clip until its pointed ends face downward and guiding the clip to said fastener guide.

20. The combination as claimed in claim 19 and further including a reciprocating sloping plate mounted on said machine, said movable bottom plate being adapted to engage and reciprocate with said sloping plate.

21. The combination as claimed in claim 19 wherein said magazine includes an opening adjacent said movable bottom plate through which said lowermost clip of fasteners passes to said machine.

22. The combination as claimed in claim 19 wherein said means for turning said lowermost clip comprises a plate mounted on said machine in the path of said lowermost clip of fasteners as it leaves said magazine.

23. The combination as claimed in claim 19 wherein said plate slopes down and away from said magazine.

* * * * *